US011189896B2

(12) United States Patent
Basavarajappa et al.

(10) Patent No.: US 11,189,896 B2
(45) Date of Patent: Nov. 30, 2021

(54) TUNABLE BANDPASS FILTER WITH CONSTANT ABSOLUTE BANDWIDTH USING SINGLE TUNING ELEMENT

(71) Applicants: Gowrish Basavarajappa, Waterloo (CA); Raafat R. Mansour, Waterloo (CA)

(72) Inventors: Gowrish Basavarajappa, Waterloo (CA); Raafat R. Mansour, Waterloo (CA)

( * ) Notice: Subject to any disclaimer, the term of this patent is extended or adjusted under 35 U.S.C. 154(b) by 0 days.

(21) Appl. No.: 16/228,587

(22) Filed: Dec. 20, 2018

(65) Prior Publication Data

US 2019/0198958 A1 Jun. 27, 2019

Related U.S. Application Data

(60) Provisional application No. 62/608,912, filed on Dec. 21, 2017.

(51) Int. Cl.

| | |
|---|---|
| ***H01P 1/208*** | (2006.01) |
| ***H01P 1/207*** | (2006.01) |
| ***H01P 7/06*** | (2006.01) |

(52) U.S. Cl.

CPC ..... *H01P 1/2084* (2013.01); *H01P 1/207* (2013.01); *H01P 7/065* (2013.01)

(58) Field of Classification Search

CPC ..... H01P 1/208; H01P 1/207; H01P 1/2084

USPC ..... 333/208, 209

See application file for complete search history.

(56) References Cited

U.S. PATENT DOCUMENTS

| | | | | |
|---|---|---|---|---|
| 2,697,209 | A | 12/1954 | Sicliak et al. | |
| 4,761,625 | A | 8/1988 | Sharma | |
| 5,808,528 | A | 9/1998 | Griffith et al. | |
| 8,878,635 | B2 | 11/2014 | Miyamoto et al. | |
| 8,975,985 | B2 | 3/2015 | Meuriche | |
| 2004/0017272 | A1 | 1/2004 | Smith et al. | |
| 2016/0049710 | A1* | 2/2016 | Huang | H01P 7/04 333/202 |

* cited by examiner

*Primary Examiner* — Rakesh B Patel

(74) *Attorney, Agent, or Firm* — Nasser Ashgriz; UIPatent Inc.

(57) ABSTRACT

The present invention is a tunable bandpass filter to provide a constant absolute bandwidth across a tuning range, comprising of a pair of resonators to determine a filter center frequency, each said resonator has a rectangular waveguide cavity, wherein said filter center frequency depends on the dimensions of said rectangular waveguide cavity; a pair of side walls attached to said pair of resonators to form a filter housing; a tuning element movably attached to at least one of said pair of side walls and extending in said filter housing and movable orthogonally to said pair of resonators, and wherein said dimensions of said rectangular waveguide cavity change by moving said tuning element, thereby said filter center frequency is changed.

4 Claims, 20 Drawing Sheets

TUNABLE BANDPASS FILTER WITH CONSTANT ABSOLUTE BANDWIDTH USING SINGLE TUNING ELEMENT

FIELD OF INVENTION

The present invention relates to the design and development of a tunable bandpass filter having a constant absolute bandwidth over the tuning range using a single tuning element. The significant aspect of the invention is that the filter achieves a constant absolute bandwidth over a wide tuning range using only one tuning element. This invention finds utility in wireless communication applications requiring frequency agile (or frequency reconfigurable) systems. The filter is especially suitable in RF, microwave and millimeter wave wireless communication applications.

BACKGROUND OF THE INVENTION

Tunable bandpass filter is one of the vital components of frequency reconfigurable (or frequency agile) wireless systems which facilitate effective utilization of allotted frequency spectrum. Furthermore, frequency reconfigurable wireless systems can be a cost effective solution for wireless base-stations as well as for satellite & aero-space applications. These systems inevitably require high Q (Quality factor) tunable bandpass filters with a constant absolute bandwidth over the tuning range. Mechanically tunable filters are capable of achieving higher Q (and hence lower loss) but they are bulky and expensive. Hence it is highly desirable to achieve filter tuning with a single tuning element (or mechanism). This not only reduces the complexity of the filter but is a highly desirable feature in millimeter wave applications where the filter size is small to accommodate many tuning elements.

Over the years significant inventions have been developed to realize tunable bandpass filters which have low loss (i.e. high Quality Factor—high Q), however as will be explored below these inventions cannot provide constant absolute bandwidth, especially when tuning range is increased even moderately.

One of the important requirements for tunable filters in most applications is to maintain constant absolute bandwidth over the tuning range. The data rate is bandwidth dependent thus maintaining the same date rate over the tuning range requires maintaining the same bandwidth. In addition, most of communication system applications require maintaining certain isolation requirements outside the band, which cannot be satisfied if the bandwidth is changed. Thus by maintaining a constant bandwidth over the tuning range, the achievable data rate and the filter isolation requirements remain the same over the entire tuning range, which is highly desirable.

With respect to tunable waveguide filters, one of the earliest inventions by William in the U.S. Pat. No. 2,697,209 is an iris coupled waveguide filter which is tuned by varying the depth of a dielectric strip in the broadside of waveguide (or narrow dimension). The invention though speculates about the possibility of bandwidth being approximately constant, however it has not addressed the design aspect of the filter considering constant absolute bandwidth.

Arvind disclosed in the U.S. Pat. No. 4,761,625 a tunable waveguide bandpass filter which has a tunable dielectric element introduced into a single septum (or E-plane) waveguide filter to change the centre frequency of the filter. This filter achieves tunability by moving a dielectric plate within the waveguide orthogonal to the metal septum. This invention too has not addressed the filter design for constant bandwidth. On similar lines, Griffith disclosed in the U.S. Pat. No. 5,808,528, a wideband tunable E-plane waveguide filter tuned by moving the conductive wall thus changing the broader dimension of the waveguide (& hence center frequency). However, the bandwidth variation within the tuning range is nearly 2:1. Thus, this invention has significant bandwidth variation and cannot achieve constant bandwidth over the tuning range. Another invention of E-plane waveguide filter disclosed by Stephanie in the US patent application No. 2004/0017272 A1. The filter is also tuned by varying the dielectric plate to affect the narrow dimensions of the waveguide and hence the center frequency. However, the focus of this invention is to build one filter structure which can be tuned to customer requirements, thus reducing the production cost. In addition of using a dielectric tuning element, the invention has not addressed the design for constant absolute bandwidth.

Takahiro disclosed in the U.S. Pat. No. 8,878,635 B2 a tunable E-plane waveguide filter where tuning is achieved by varying the relative position of a dielectric plate with respect to metallic septum. The filter has two configurations, one where dielectric plate is rotated within the waveguide and the other where dielectric plate is moved into and out of the waveguide. In the first configuration, the bandwidth variation is nearly 28% and in the second configuration, the bandwidth variation is nearly 22%, which is considerably larger. Meuriche disclosed in the U.S. Pat. No. 8,975,985 B2 an iris coupled tunable waveguide filter. The tuning range achieved is +−5% and bandwidth variation is also +−5%. The basic invention has bandwidth dependency to the tuning range, that is, larger the tuning range of the filter, larger will be the bandwidth variation. Furthermore, the invention has not addressed the design methodology to accommodate constant absolute bandwidth.

The majority of the reported inventions of rectangular waveguide filters use dielectric tuning elements and do not present means to realize tunable filters with a constant absolute bandwidth. Furthermore, metal tuning elements are much easier to machine, are lower in cost and can be easily attached to tuning mechanisms such as a piezoelectric or a mechanical motor, or a MEMS actuator.

In this invention prototype of a tunable E-plane double septum waveguide filter is disclosed. Where the position, spacing, and width of the metallic septa are systematically designed to achieve the inter-resonator couplings required for constant bandwidth. The probe length, position and spacing are also systematically designed to achieve the input-output couplings required for constant bandwidth.

Tunability is achieved by moving a side metal plate into and out of the waveguide orthogonal to two metallic septa. Furthermore, the movable side metal plate is patterned to improve both the spurious performance of the filter and to enhance its tuning range.

SUMMARY OF THE INVENTION

The principal objective of the present invention is the provision of a novel configuration for a waveguide tunable filter that is capable of realizing constant absolute bandwidth over a wide tuning range using a single metal tuning element.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF THE DRAWINGS

A detailed literature survey on the prior art revealed that a waveguide tunable filter which can achieve wider tuning range with constant absolute bandwidth has not been addressed especially so from design perspective. In this regard, the present invention has systematically addressed these requirements. The requirement of constant absolute bandwidth is taken into account right at the beginning of the design. In general, waveguide filters using cavity resonators can be designed using two methods/models:

a) Model based on Coupling Co-efficient, and b) Model based on Impedance Inverter.

a) Model Based on Coupling Co-Efficient

In this model, the entire filter design can be divided into two major steps. One is to design appropriate coupling between the resonators (i.e. inter-resonator coupling), and the other step is to design input/output coupling where the filter is connected to other external components/sub-system in an application. The inter-resonator coupling and input/output couplings can be expressed using equation 1 and equation 2, respectively as disclosed in the prior art.

$$k_{ij}*f_r=M_{ij}*BW \quad \text{equation 1}$$

$$\tau_{s11_max}=4/(2\pi*BW*M_{s1}^2) \quad \text{equation 2}$$

where, $k_{ij}$ is the physical coupling co-efficient between the resonators, $f_r$ is the centre frequency, $M_{ij}$ is the normalized coupling co-efficient between the resonators, BW is the absolute bandwidth, $M_{s1}$ is the normalized coupling co-efficient at input (or output) and $\tau_{s11_max}$ is the peak input (or output) reflection group delay. The normalized coupling co-efficient ($M_{ij}$ and $M_{s1}$) depends only on the filter type and its order, and not on center frequency and bandwidth. As a result from the model based on coupling co-efficient, the two key requirements to design a filter for constant absolute bandwidth are:

1) a constant peak input/output reflection group delay ($\tau_{s11_max}$) w.r.t to $f_r$ (center frequency) over the tuning range, and 2) a constant $k_{ij}*f_r$ product over the tuning range.

Figure 3A:
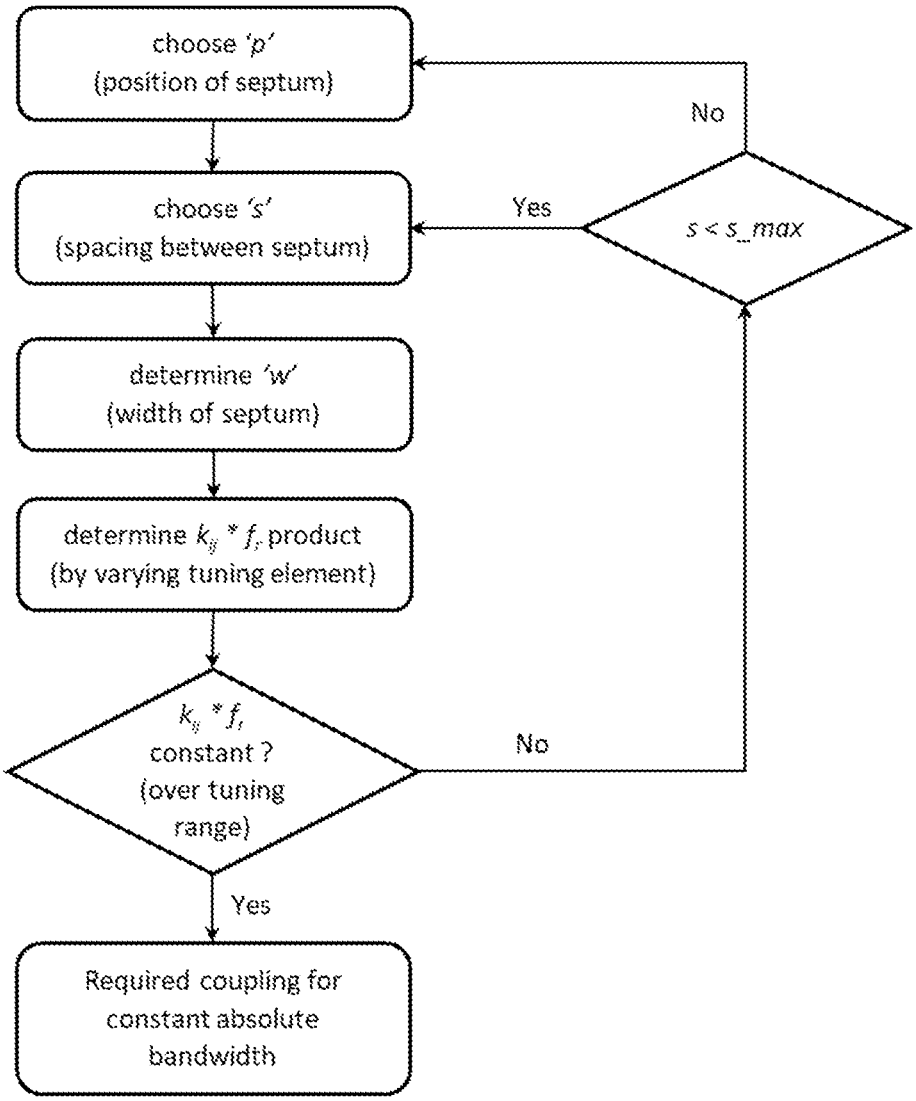
FIG. 3*a* shows a flowchart for designing inter-resonator coupling.
Figure 3B:
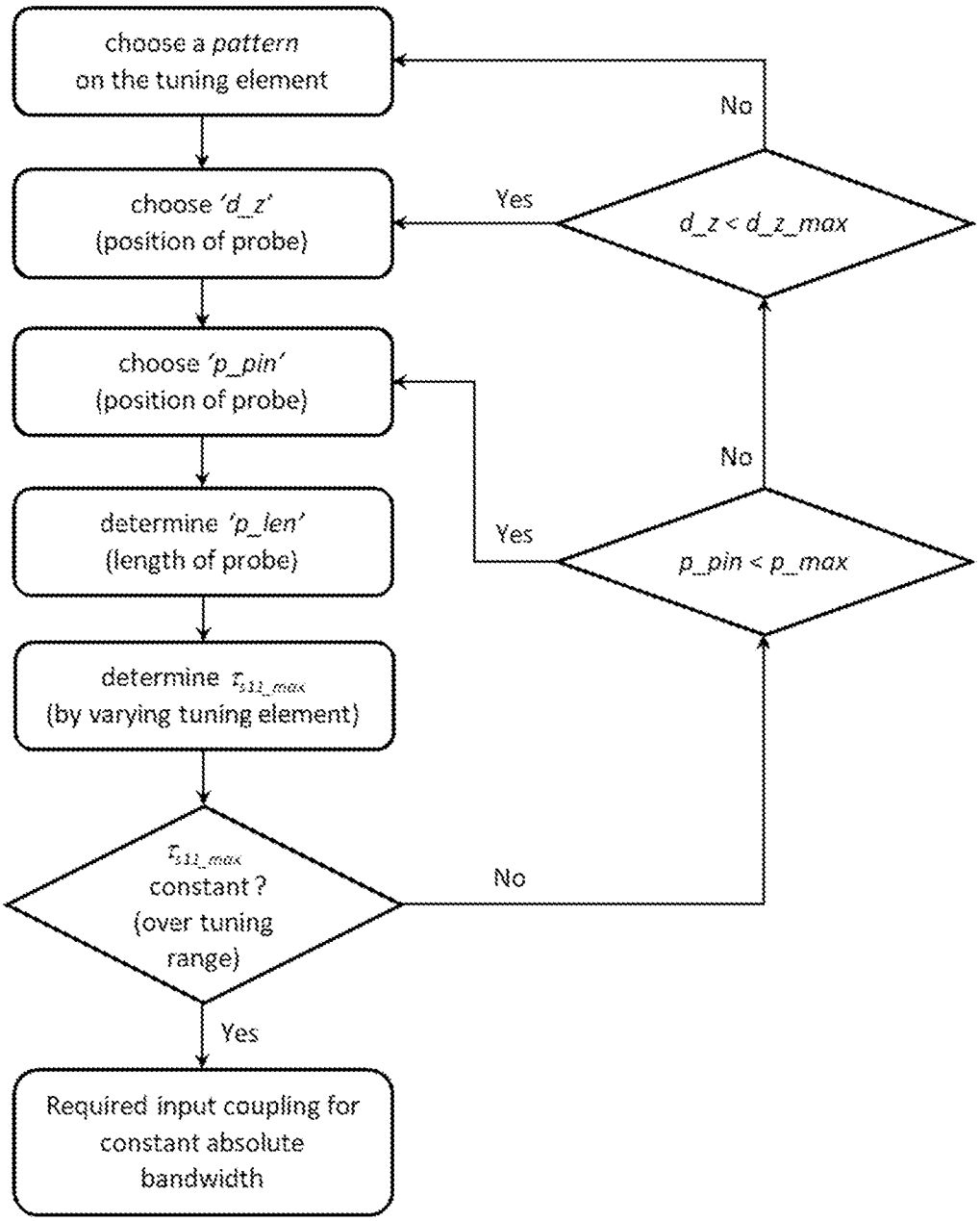
FIG. 3*b* shows the flowchart for designing input/output coupling.
Figure 3C:
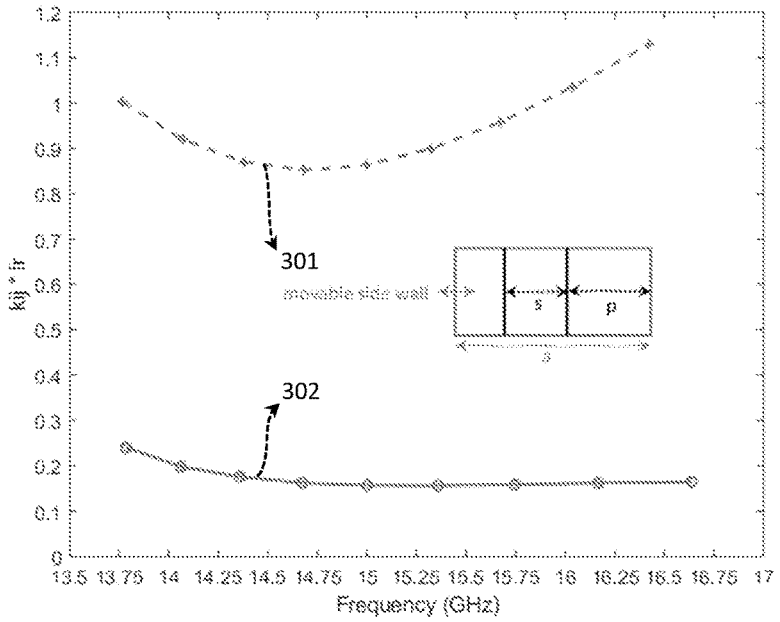
FIG. 3*c* shows the inter-resonator coupling behavior of the invention when designed using model based on coupling co-efficient.
Figure 4A:
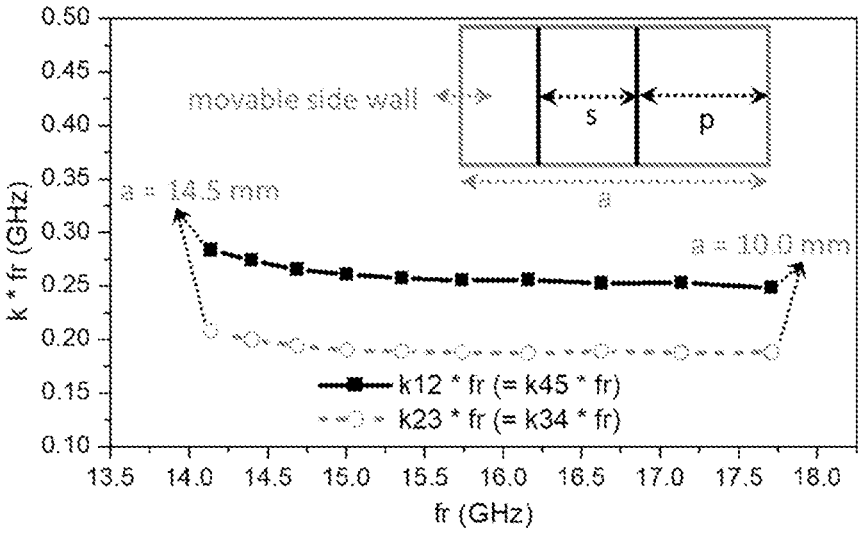
FIG. 4*a* is the plot of inter-resonator coupling.
Figure 4B:
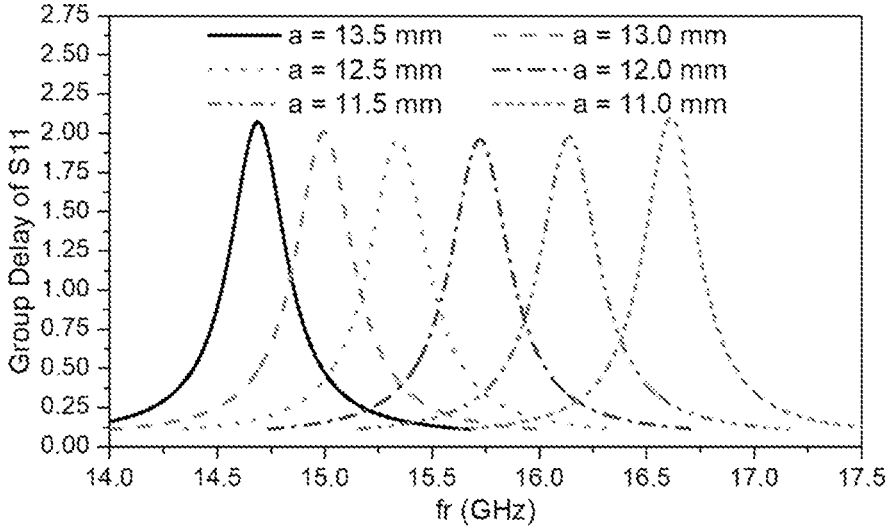
FIG. 4*b* is the plot of input/output coupling.
Figure 4C:
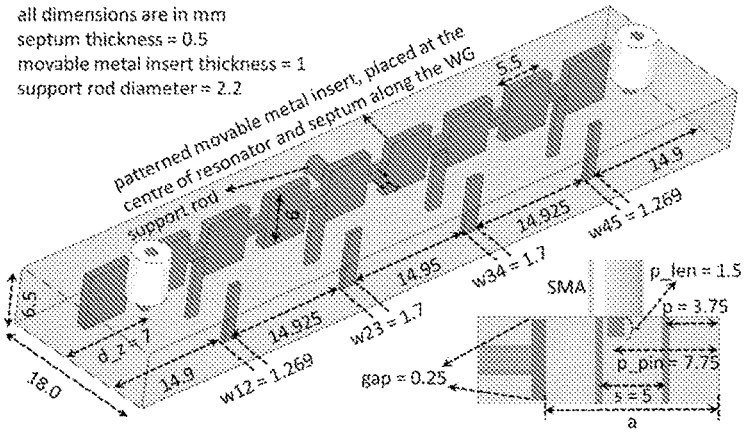
FIG. 4*c* shows a schematic of the filter with detailed internal dimensions.
Figure 9A:
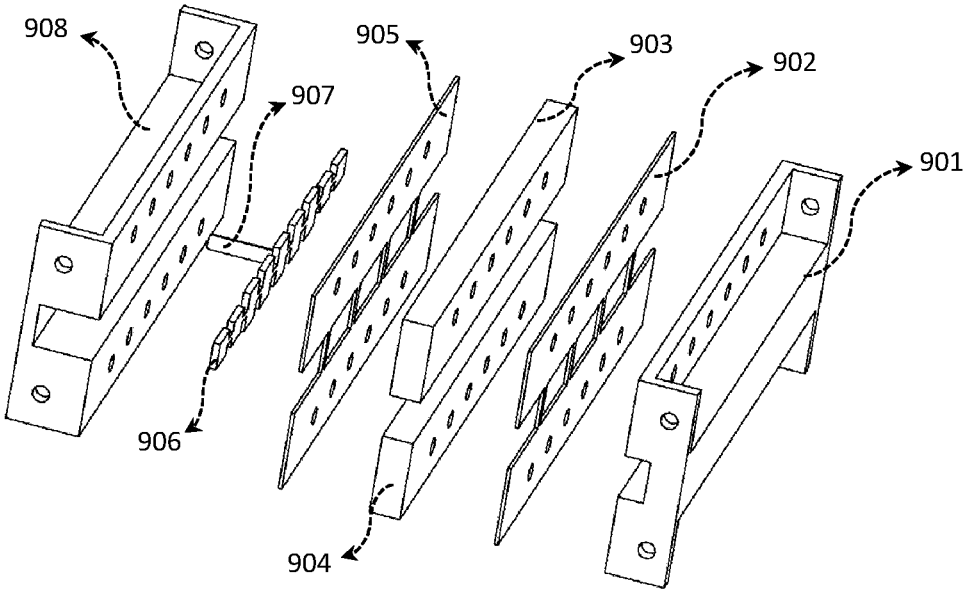
FIG. 9*a* shows the variation of the invention with waveguide input/output feeding.
Figure 9B:
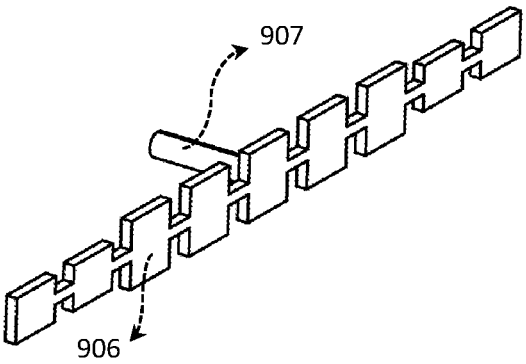
FIG. 9*b* shows the variation of the invention with waveguide input/output feeding.
Figure 9C:
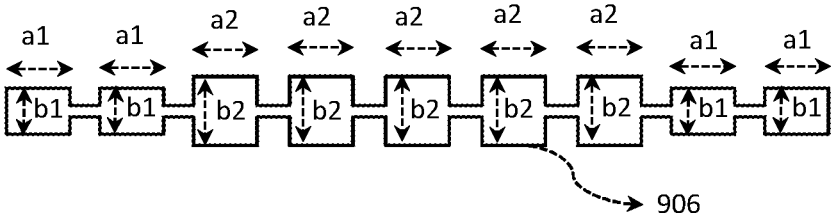
FIG. 9*c* shows the variation of the invention with waveguide input/output feeding.

The next step is to realize the physical inter-resonator coupling and input/output coupling to match the above requirements. Inter-resonator coupling is realized using metallic double septum. The septum has three degrees of freedom as shown in FIG. 3*c* and FIG. 4*c*, where the spacing ('s'), position ('p') and width of the septum can be chosen appropriately such that $k_{ij}*f_r$ product is constant over the tuning range. FIG. 3*a* depicts the flowchart for designing the inter-resonator coupling for the tunable filter to obtain constant absolute bandwidth over the tuning range. To realize inter-resonator coupling the number of septa in the filter can be more than two like the filter showed in FIG. 5 which has three septa. The investigation during the invention revealed that more the number of septa, larger will be the tuning range that can be achieved. The input/output coupling is realized using a probe. The probe has three degrees of freedom as shown in FIG. 4*c*, where pin length ('p_len') and its position ('p_pos' & 'd_z') can be chosen appropriately such that peak input/output reflection group delay ($\tau_{s11_max}$) is constant over the tuning range. In-addition the pattern on the tuning plate can be altered differently for the input-output resonator as compared to rest of the resonators, thus providing additional degree of freedom. FIG. 9*b* and FIG. 9*c* shows one of such possibilities of patterning the tuning element. FIG. 3*b* depicts the flowchart for designing the input/output coupling for the tunable filter to obtain constant absolute bandwidth over the tuning range. In a similar manner, input/output coupling can be realized using structures other than probe coupling like loop couplings, direct waveguide feeding. One such waveguide feeding with septum based input/output coupling is depicted in FIG. 9*a*.

b) Model Based on Impedance Inverter

In this model, the filter design basically involves designing appropriate impedance inverters between the resonators. The impedance inverter can be expressed using equation 3 and equation 4 for inter-resonator coupling and using equation 5 for input/output coupling as disclosed in the prior art.

$$\frac{K_{n,n+1}}{Z_0} f_r = \frac{\pi\ BW}{2\sqrt{g_n\, g_{n+1}}} \quad \text{equation 3}$$

$$l_n = \frac{\lambda_{gr}}{360}[180 + 0.5 * (\phi_n + \phi_{n+1})] \quad \text{equation 4}$$

$$\frac{K_{0,1}}{Z_0}\sqrt{f_r} = \sqrt{\frac{\pi\ BW}{2 g_0 g_1}} \quad \text{equation 5}$$

where $K_{n,n+1}$ is the value of impedance inverter, $f_r$ is the centre frequency, $\lambda_{gr}$ is the wavelength at centre frequency, $g_n$ is the normalized filter co-efficient, $\phi_n$ is the phase contribution from the impedance inverter in degrees, BW is the absolute bandwidth, $Z_0$ is the characteristic impedance of the waveguide. The normalized filter co-efficient (i.e. $g_n$) depend only on filter type and its order, and hence they are independent on centre frequency and bandwidth. As a result from the model based on impedance inverter, the two key requirements to design a filter for constant absolute bandwidth are:

1) a constant $(K_{n,n+1}/Z_0)*f_r$ product over the tuning range for inter-resonator coupling;
2) a constant $(K_{n,n+1}/Z_0)*(f_r)^{0.5}$ product over the tuning range for input/output coupling, and
3) a constant phase contribution ($\phi_n$) from the impedance inverter over the tuning range.

The next step is to realize the impedance inverters to match the above requirements such that the resultant tunable filter has constant absolute bandwidth over the tuning range. The design procedure is similar to that developed in FIG. 3*a* and FIG. 3*b*.

Figure 1A:
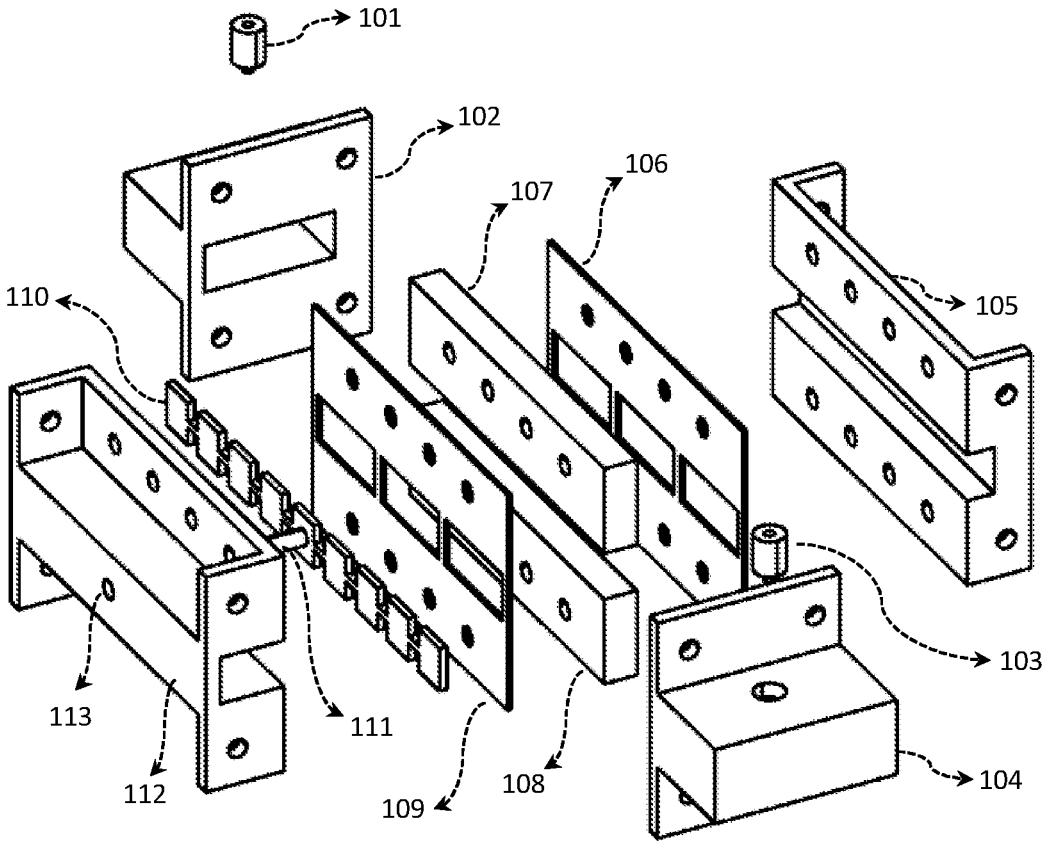
FIG. 1*a* shows an isometric view of the invention in exploded condition identifying different parts of the tunable waveguide filter.
Figure 1B:
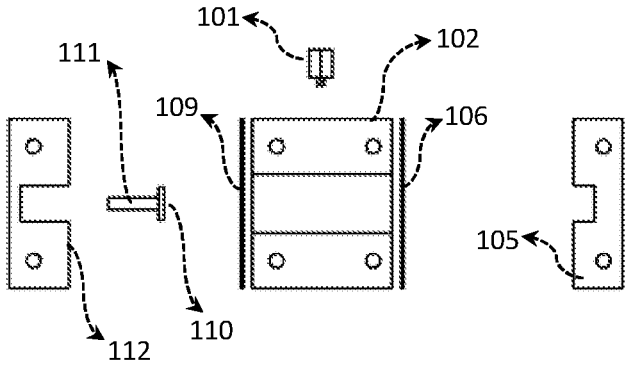
FIG. 1*b* shows a front view of the invention.
Figure 1C:
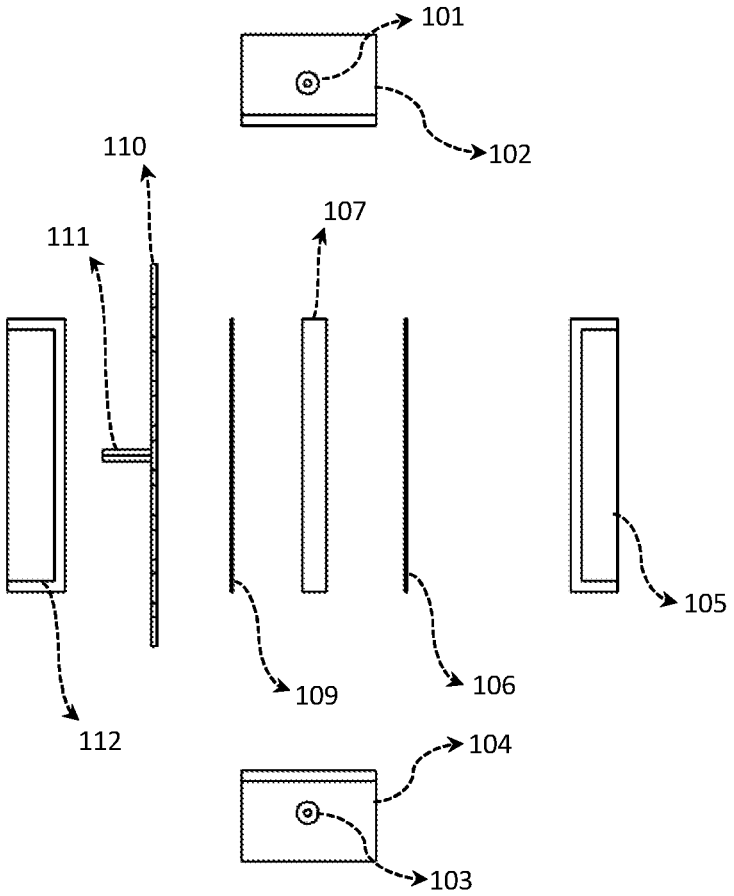
FIG. 1*c* shows a top view of the invention.
Figure 1D:
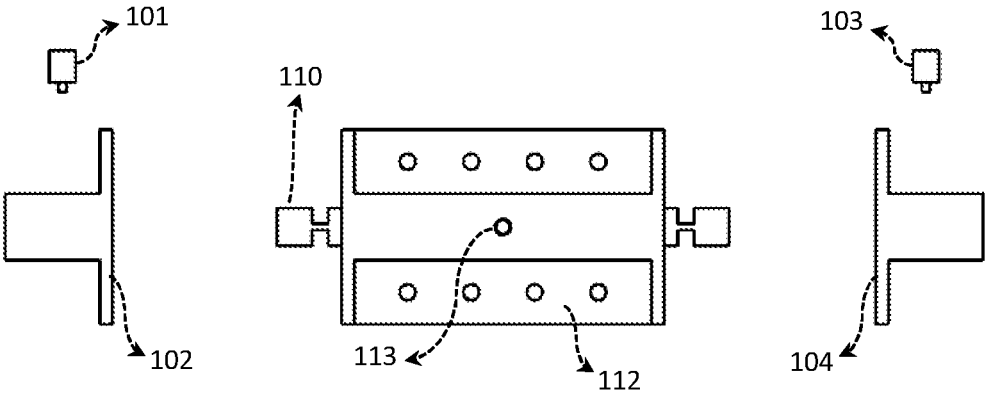
FIG. 1*d* shows a side view of the invention.

FIGS. 1*a*, 1*b*, 1*c*, 1*d* depict the drawings of the first embodiment of the invention in exploded condition identifying different parts of the tunable waveguide filter. The isometric view is shown in FIG. 1*a*. The input/output probes 101 and 103 are inserted into the input/output resonators 102 and 104, respectively. The inner dimension of the fixed side wall 105 is determined by the position of the septum ('p'). The septa 106 and 109 contain the required coupling widths ('w'). The spacers 107 and 108 maintain the required spacing between the septa ('s'). The tuning element 110 is connected to a support 111. The tuning element 110 is moved into and out of the waveguide orthogonally to the septum 109. The side wall 112 is assembled such that the support 111 extends out through the hole 113 in the side wall 112. A small gap is maintained between the tuning element 110 and the side wall 112 to facilitate friction free movement of the tuning element 110. When the tuning element 110 moves into and out of the waveguide, basically it alters the broader dimension of the filter, thus changing the resonant frequency of all resonators and hence the centre frequency of the filter. The couplings are designed using flowcharts shown in FIG. 3*a* and FIG. 3*b* such that the absolute bandwidth remains constant over the entire tuning range, even when the tuning element 110 is moved. The front view of the filter is shown in FIG. 1*b*, the top view in FIG. 1*c* and the side view in FIG. 1*d*.

Figure 2A:
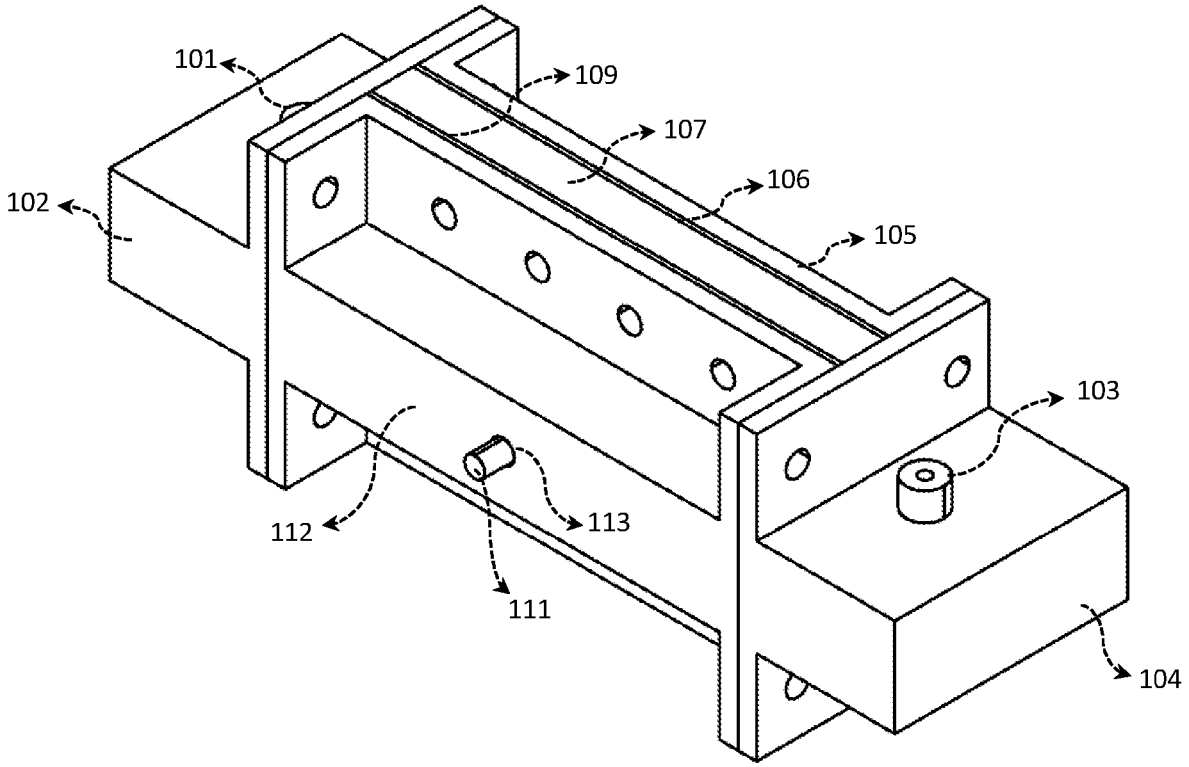
FIG. 2*a* shows an isometric view of the invention when assembled.
Figure 2B:
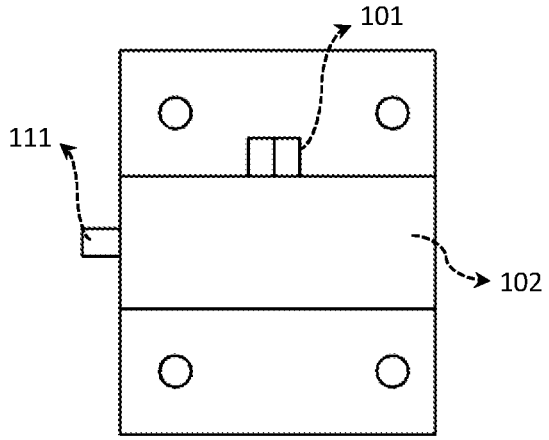
FIG. 2*b* shows a front view of the invention when assembled.
Figure 2C:
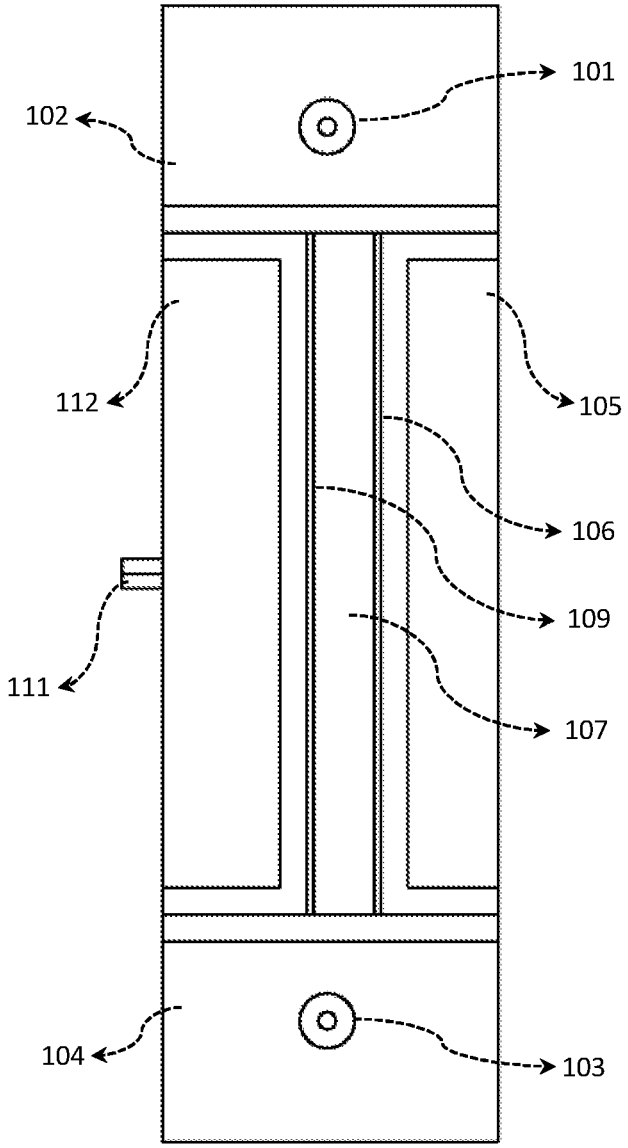
FIG. 2*c* shows a top view of the invention when assembled.
Figure 2D:
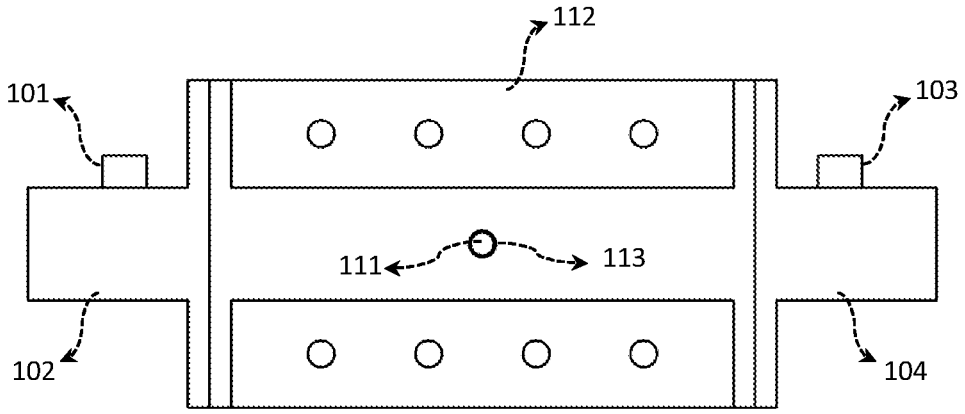
FIG. 2*d* shows a side view of the invention when assembled.

FIGS. 2*a*, 2*b*, 2*c* and 2*d* depict the drawings of the first embodiment of the invention in the assembled condition identifying different parts of the tunable waveguide filter. The isometric view is shown in FIG. 2*a*. To start with side wall 105, septum 106, spacers 107 (& 108—not visible in assembly view of FIG. 2*a*: same as 108 in exploded view of FIG. 1*a*), and septum 109 are assembled together. Following this, tuning element 110 (not visible in assembly view of FIG. 2*a*: same as 110 in exploded view of FIG. 1*a*) and the other side wall 112 are connected to the above assembly. The support 111 is attached the tuning element 110. The support 111 extends outside through the hole 113 in the side wall 112. Finally input resonators 102 and 104, along with input probes 101 and 103 are connected to complete the filter assembly. The tuning element 110 is moved into and out of the waveguide using the extended support 111. The front view of the filter is shown in FIG. 2*b*, the top view in FIG. 2*c* and the side view in FIG. 2*d*.

Figure 4D:
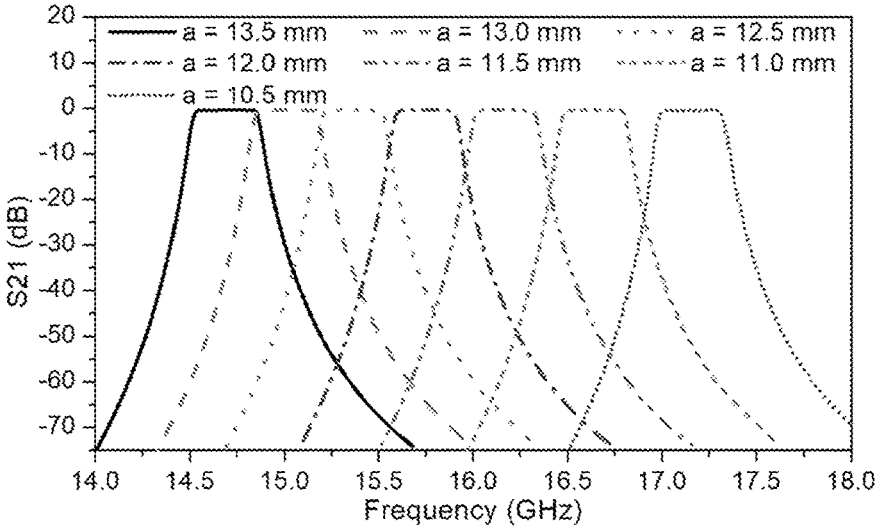
FIG. 4*d* shows the transmission co-efficient ($S_{21}$) of the tunable waveguide filter.
Figure 4E:
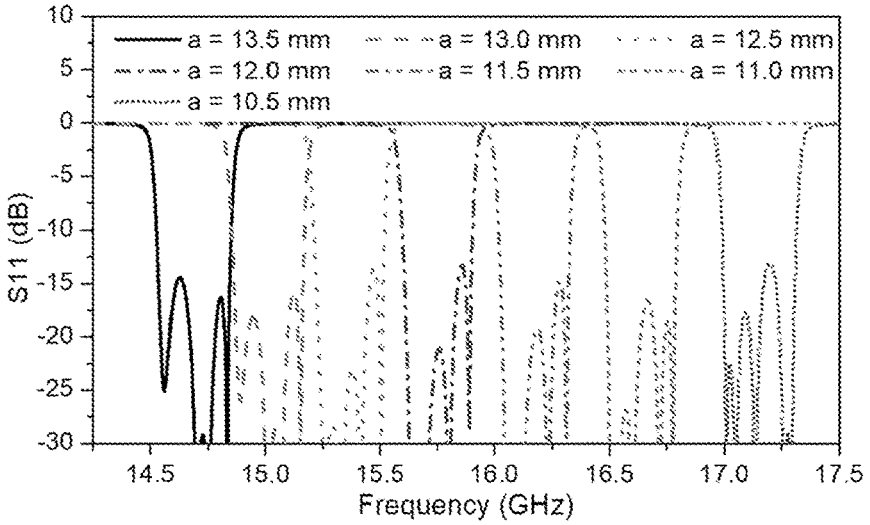
FIG. 4*e* shows the reflection co-efficient ($S_{11}$) of the tunable waveguide filter.
Figure 4F:
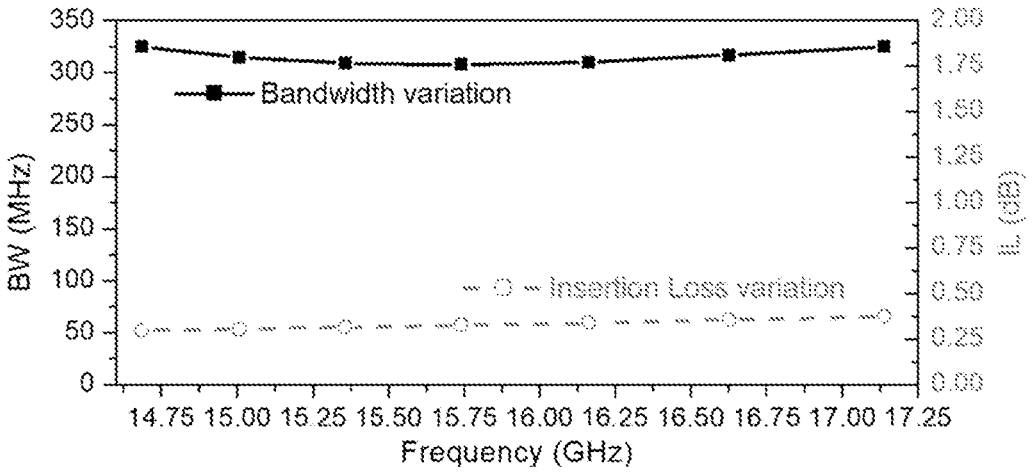
FIG. 4*f* shows the bandwidth variation and loss (insertion loss) variation over the tuning range.

Schematic of the prototype filter is shown in FIG. 4*c* with details of all internal dimensions. The obtained constant $k_{ij}*f_r$ product for the filter is plotted in FIG. 4*a*. Similarly obtained constant peak input/output reflection group delay ($\tau_{s11_max}$) is plotted in FIG. 4*b*. The reflection co-efficient ($S_{11}$) of the prototype for different positions of the tuning element is shown in FIG. 4*d*. The corresponding transmission co-efficient ($S_{21}$) of the prototype is shown in FIG. 4*e*. FIG. 4*f* shows the absolute bandwidth and insertion loss of the prototype filter over the tuning range. It can be seen from FIG. 4*f* that the absolute bandwidth is constant (variation is less than +−5%) over the entire tuning range from 14.65 GHz to 17.15 GHz (i.e. 2.5 GHz or 15.7%).

Figure 3D:
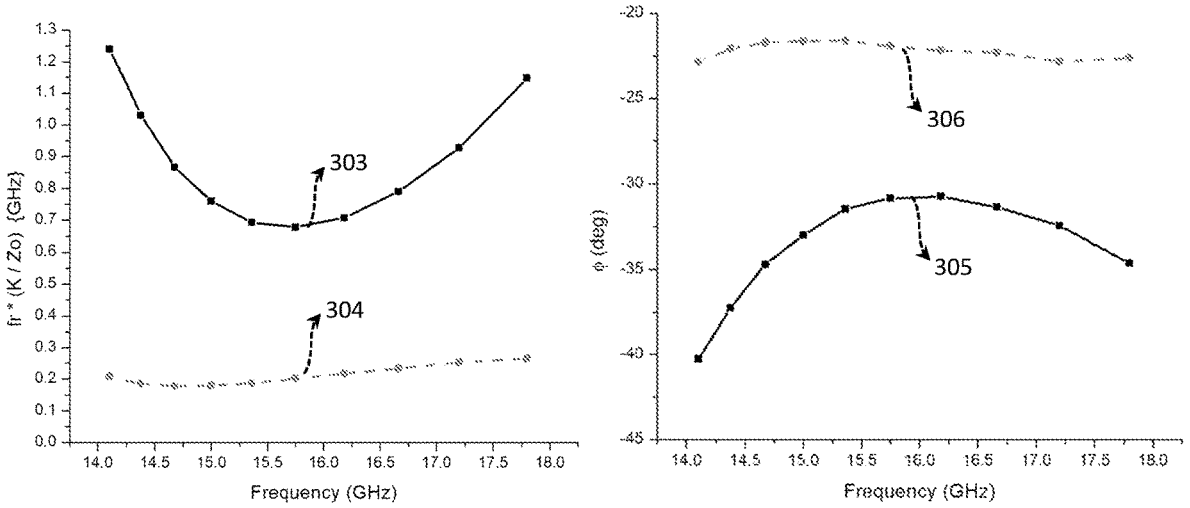
FIG. 3*d* shows the inter-resonator coupling behavior of the invention when designed using model based on impedance inverter.
Figure 5:
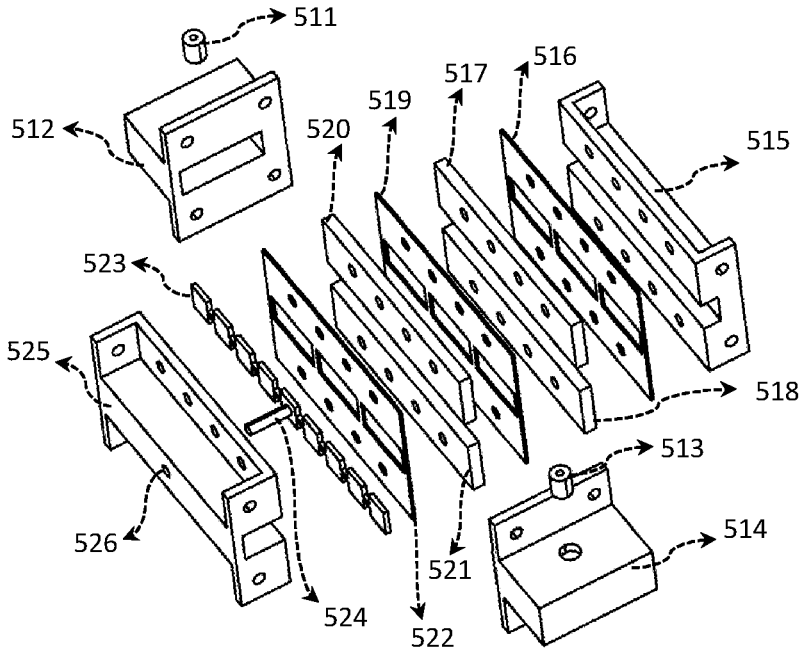
FIG. 5 shows another embodiment of the invention primarily focused on number of septa, the number of metallic septa can be more than two, the number of metallic septa beyond two gives wider tuning range.

FIG. 5 depicts one of the variations of the invention, where the number of metallic septa can be more than two, (three septa). During the investigation of the invention it is determined that the filter with double septum achieves larger tuning range (with constant absolute bandwidth) than the filter with single septum. FIG. 3*c* shows the graph of $k_{ij}*f_r$ product for single and double septum. Curve 301 in FIG. 3*c* is the $k_{ij}*f_r$ product for single septum, whereas curve 302 is the $k_{ij}*f_r$ product for double septum. Thus it can be observed from FIG. 3*c* that double septum provides significantly wider tuning range compared to single septum. A similar conclusion is obtained from the model based on impedance inverter as shown in FIG. 3*d*. Curve 303 is the $(K_{n,n+1}/Z_0)*f_r$ product and curve 305 is the corresponding phase contribution ($\phi_n$) for the single septum. Curve 304 is the $(K_{n,n+1}/Z_0)*f_r$ product and curve 306 is the corresponding phase contribution ($\phi_n$) for the double septum. Thus it can be observed from FIG. 3*d* that double septum provides significantly wider tuning range compared to single septum. Thus it can be concluded that filter with higher number of septa provides larger tuning range. One of the reasons for this behavior is that filters with higher number of septa have additional degrees of freedom in the design. For example, the filter with three septa shown in FIG. 5, has two spacers 517-518 and 520-521 whose thickness can be different. Thus there is additional degree of freedom compared to double septum.

Figure 6A:
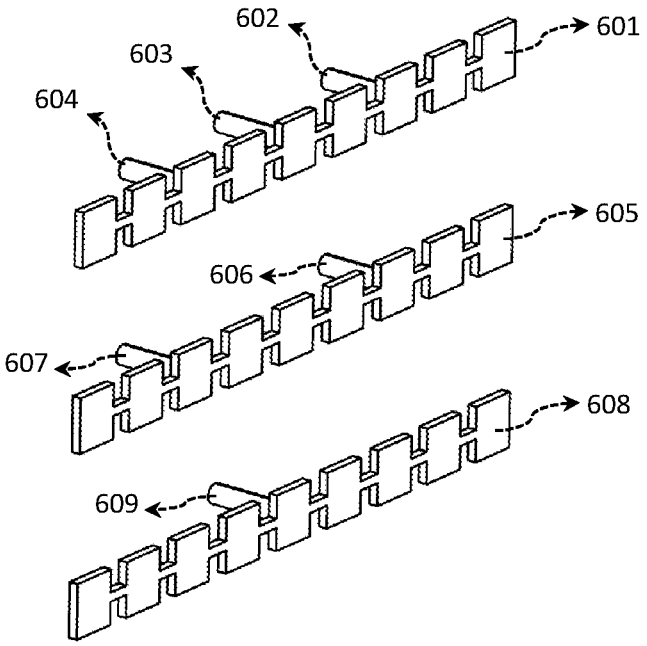
FIG. 6*a* depicts an isometric view of the possible variation, where the number of supports can be more than one.

FIG. 6*a* depicts variation of the movable tuning element. The number of supports of the tuning element can be other than one. For example, the tuning element 608 has only one support 609, the tuning element 605 has two supports 606 and 607, the tuning element 601 has three supports 602, 603 and 604.

Figure 6B:
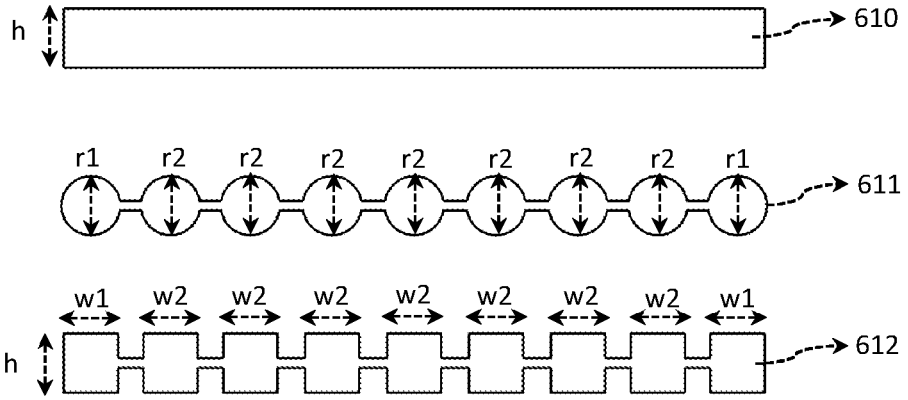
FIG. 6*b* depicts a front view of another possible variation of the pattern itself.

FIG. 6*b* depicts the variation of the movable tuning element where the pattern of the plate can be other than step/rectangular variations. The tuning element 610 has no pattern in it. The investigation revealed that filter with such a tuning element can have spurious modes which affect the in-band and spurious performance of the filter. The tuning element 612 has stepped variation in its pattern to eliminate the spurious modes (to push the spurious modes far off by reducing the widths w1 and w2). Furthermore, the widths w1 correspond to input/output resonator and w2 correspond to other resonators. They need not be same, which provides additional degree of freedom for the design. In general, width of the pattern can be different for each resonator and for the coupling. The tuning element 611 has circular variation in its pattern to eliminate the spurious modes (to push the spurious modes far off by reducing the diameter r1 and r2). In addition the pattern on the tuning element can be of any suitable shape which helps to eliminate the spurious modes (to push the spurious modes far off).

Figure 6C:
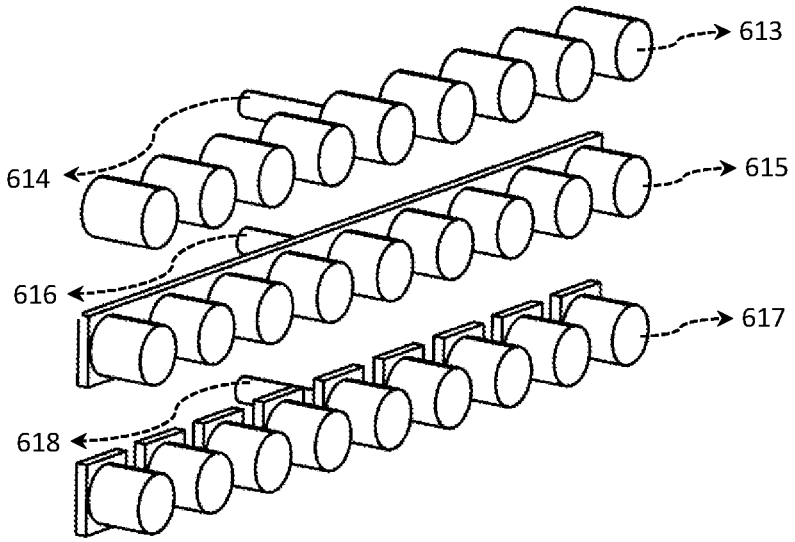
FIG. 6*c* shows an isometric view of the variation which include the metallic stubs on the movable tuning element, the stubs themselves can have varied patterns.
Figure 6D:
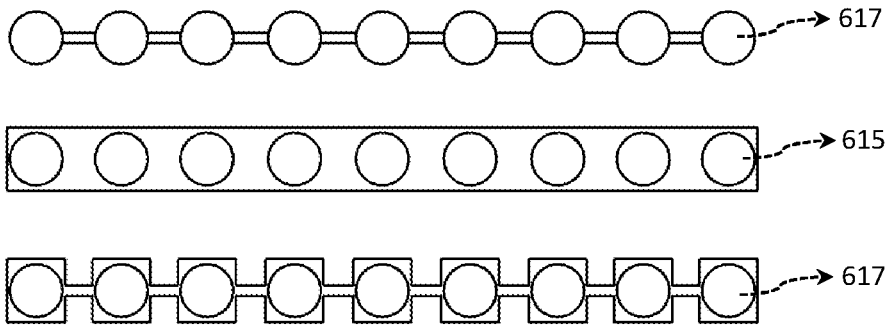
FIG. 6*d* shows a front view of the variation which include the metallic stubs on the movable tuning element, the stubs themselves can have varied patterns.

FIG. 6*c* and FIG. 6*d* depict another variation in tuning element which includes stubs over the pattern. The stubs shown in FIG. 6*c* are cylindrical. In general the stubs can be of any suitable shape which helps to tune the resonant frequency of the filter.

Figure 7:
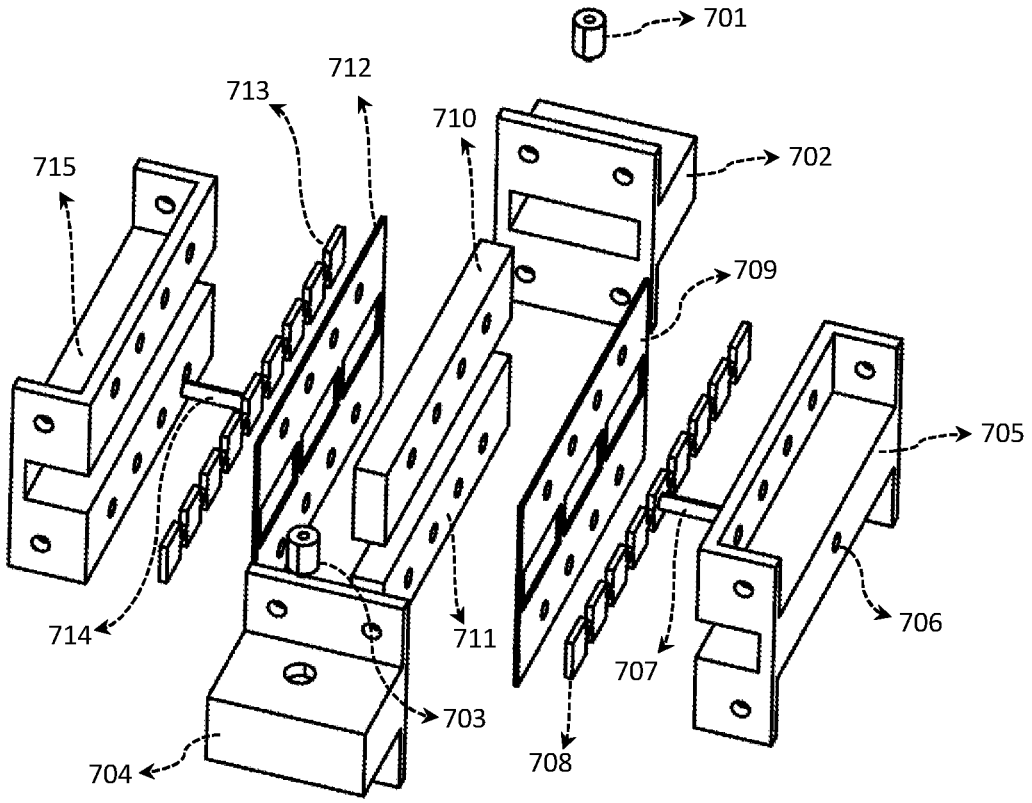
FIG. 7 depicts the variation of the invention where the tuning elements can be placed on both the sides of the filter, the exploded isometric view of the variation is depicted in the figure.

FIG. 7 shows the variation of the filter where movable tuning elements 708 and 713 are placed on either sides of the filter. They can either be moved using independent mechanism or coupled mechanism.

Figure 8A:
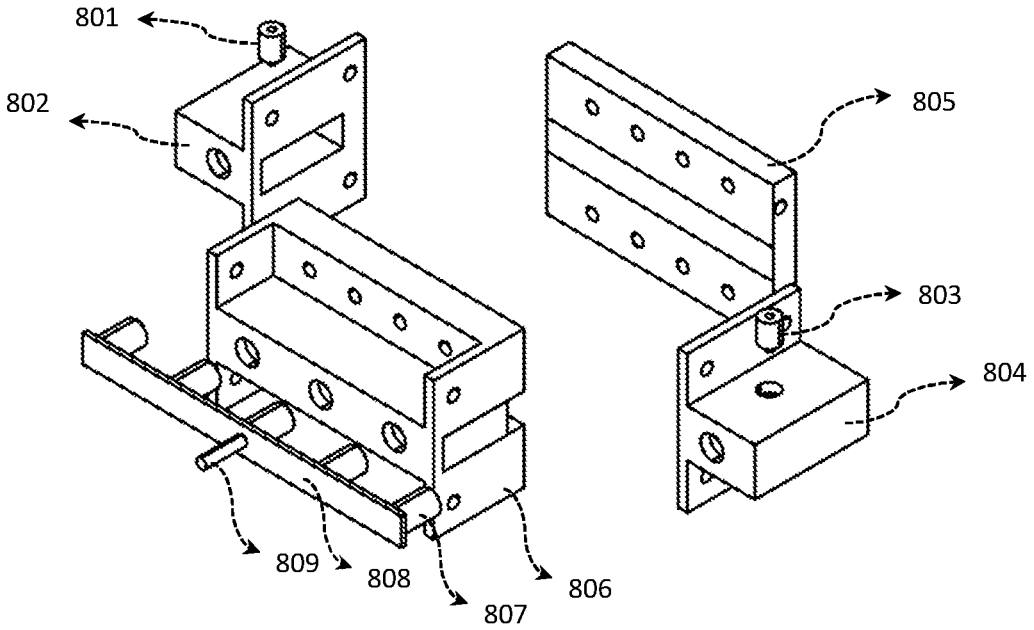
FIG. 8*a* shows the variation of the invention where iris coupling is used instead of metallic septa.
Figure 8B:
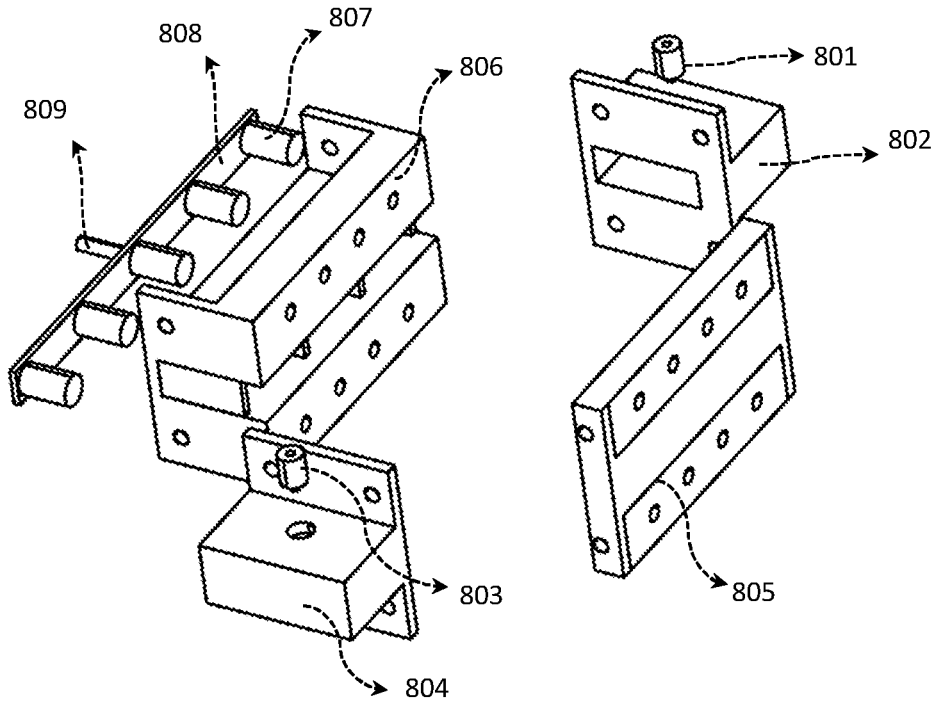
FIG. 8*b* shows the variation of the invention where iris coupling is used instead of metallic septa.

FIGS. 8*a* and 8*b* depict the drawings of the second embodiment of the invention which is an iris coupled tunable waveguide filter. In this filter, the stubs 807 on the movable tuning element 808 help to tune the center frequency of the filter. By moving the tuning element 808, the stub 807 position inside the waveguide is varied and thus the resonant frequency is altered. The procedure depicted FIG. 3*a* and FIG. 3*b* is used to design iris couplings such that the tunable filter has constant absolute bandwidth over the tuning range.

FIGS. 9*a*, 9*b* and 9*c* show the variation of the filter with waveguide feeding where the metallic septum is used for input/output coupling, in-addition to inter-resonator coupling. As explored earlier in equation 1 (or equation 3) and equation 2 (or equation 5), the frequency dependent of input/output coupling is different from that of inter-resonator coupling to achieve constant absolute bandwidth. Hence the pattern on tuning element 906 has to be suitably designed. FIG. 9*b* and FIG. 9*c* shows one of the possibilities of patterning the tuning element for such a filter. In this case, the pattern (a1, b1) on the tuning element 906 for the input/output resonator is such that equation 1 (or equation 3) is satisfied. The pattern (a2, b2) on the tuning element 906 for rest of the resonators is such that equation 2 (or equation 5) is satisfied. Similarly, other waveguide couplings like iris coupling (similar to inter-resonator coupling in the variation depicted in FIG. 8*a* and FIG. 8*b*) can also be employed.

In general, a tunable waveguide filter may include any or all of the focused variations depending on the application as hand.

Figure 10:
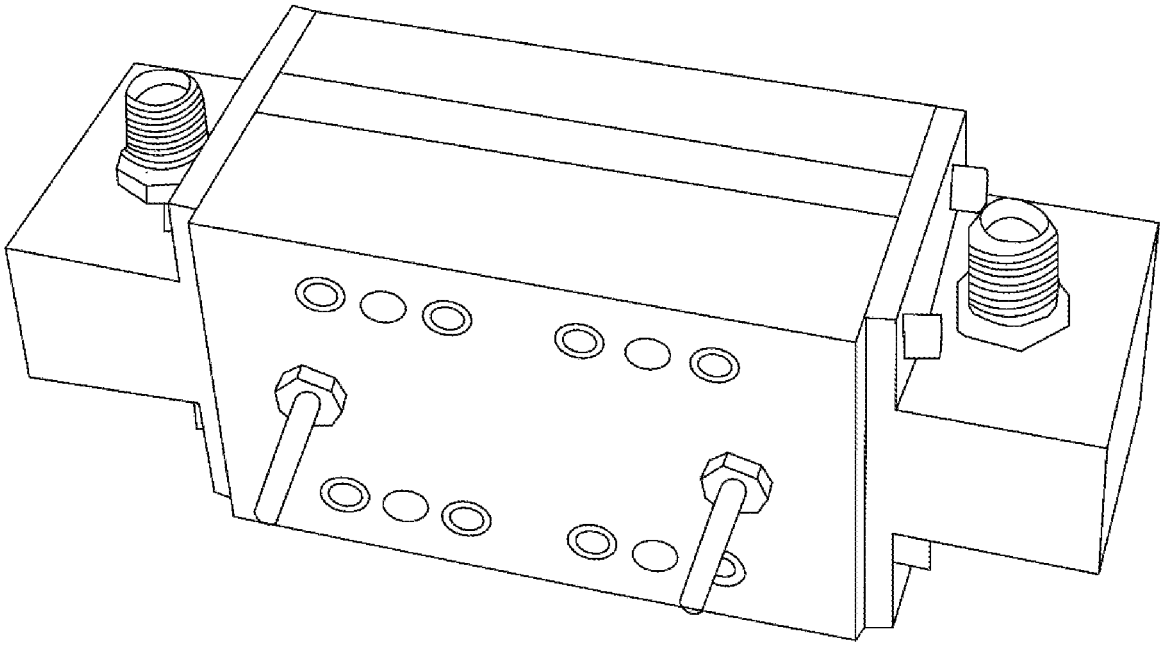
FIG. 10 shows a photo of a fabricated unit.
Figure 11A:
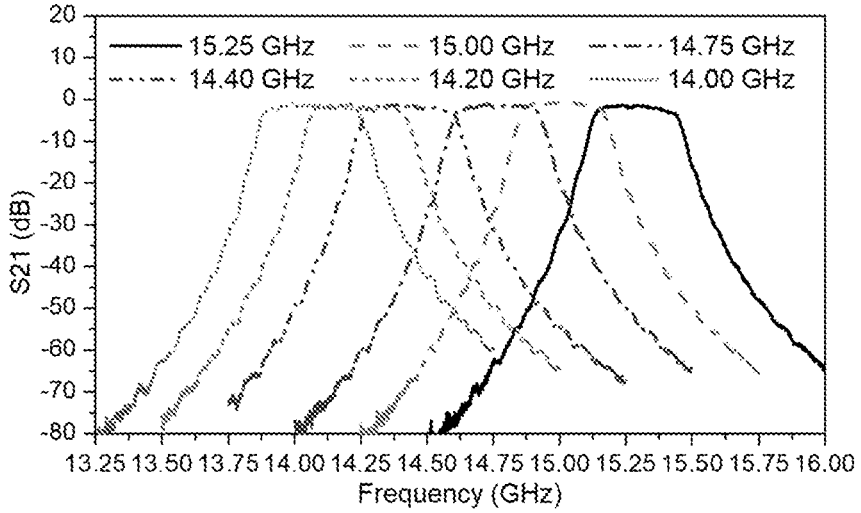
FIG. 11*a* shows a diagram of measured transmission co-efficient ($S_{21}$) of the tunable filter.
Figure 11B:
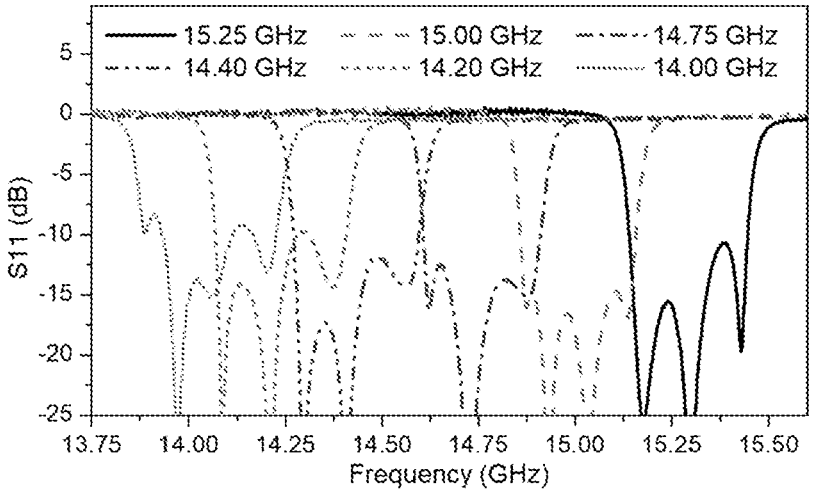
FIG. 11*b* shows a diagram of measured reflection co-efficient ($S_{11}$) of the tunable filter.
Figure 11C:
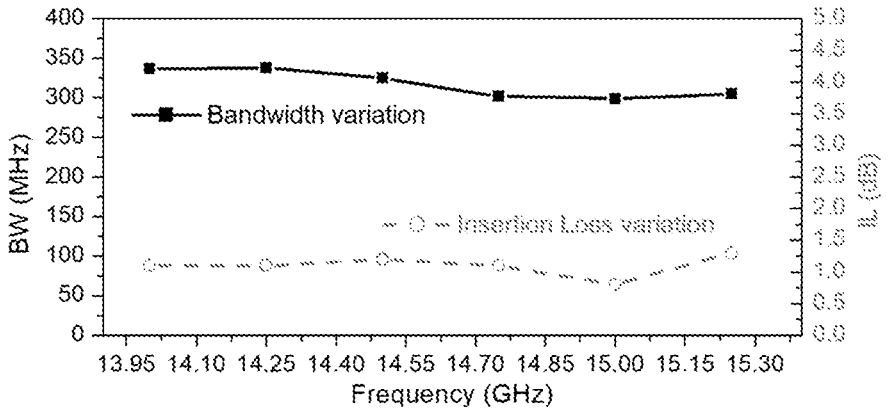
FIG. 11*c* shows a diagram of measured BW and IL variation over the tuning range.

FIG. 10 shows a photo of a prototype unit developed as a proof of concept. Copper is used for the two waveguide halves, two septa, and for the movable sidewall. Whereas aluminum is used for input & output resonators to minimize the corner radius during fabrication. Support rods have been built with a provision to be moved inside one of the WG halves using a piezoelectric or a mechanical motor, or a MEMS actuator (not shown). FIG. 11*a* and FIG. 11*b* depict the measured response of the filter. Tuning range of the filter is 1.25 GHz (from 14.0 GHz to 15.25 GHz). The measured variations of BW and IL over the tuning range are shown in FIG. 11*c*. The increase in the measured insertion loss of around 1.0 dB is attributed predominantly to the surface roughness and the use of stainless steel rods that hold the metal insert tuning element in this initial prototype. Silver plating the whole filter including the rods will certainly help in improving the insertion loss of the filter.

The foregoing is considered as illustrative only of the principles of the invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. An iris waveguide filter to provide a constant absolute bandwidth across a tuning range using a tuning element, comprising:

a) a pair of resonators to determine a filter center frequency, each said resonator has a rectangular waveguide cavity, wherein said filter center frequency depends on the dimensions of said rectangular waveguide cavity;

b) a pair of side walls attached to said pair of resonators to form a filter housing;

c) a tuning element movably attached to at least one of said pair of side walls and extending in said filter housing and movable orthogonally to said pair of resonators, and wherein said dimensions of one of said rectangular waveguide cavities change by moving said tuning element, thereby said filter center frequency is changed, and wherein said tuning element is shaped in a form of corrugations to improve both a filter spurious performance and a filter tuning range, and d) a pair of input/output couplings to provide a reflection co-efficient of the tunable bandpass filter, and to cause an input power entering the filter with minimum reflections.

2. A tunable bandpass filter to provide a constant absolute bandwidth across a tuning range, comprising:

a) a pair of resonators to determine a filter center frequency, each said resonator has a rectangular waveguide cavity, wherein said filter center frequency depends on the dimensions of said rectangular waveguide cavity;

b) a pair of side walls attached to said pair of resonators to form a filter housing;

c) a tuning element movably attached to at least one of said pair of side walls and extending in said filter housing and movable orthogonally to said pair of resonators, and wherein said dimensions of one of said rectangular waveguide cavities change by moving said tuning element, thereby said filter center frequency is changed;

d) a plurality of inter-resonator coupling structures to provide a filter bandwidth, each of said plurality of inter-resonator coupling structures located at a pre-defined location between said pair of resonators to couple an energy from one rectangular waveguide cavity to another rectangular waveguide cavity, thereby providing a band-pass frequency behavior and to ensure that the filter bandwidth remains constant even when the dimensions of one of said rectangular waveguide cavities are changed by moving the tuning element, and wherein said plurality of inter-resonator coupling structures comprises of at least a pair of septums, wherein a position, a spacing, and a width of the pair of septums is designed to achieve the constant bandwidth, and e) a pair of input/output couplings to provide a reflection co-efficient of the tunable bandpass filter, and to cause an input power entering the filter with minimum reflections.

3. The tunable bandpass filter of claim 2, wherein said tuning element further comprises of a patterned tuning element.

4. The tunable bandpass filter of claim 2, wherein said tuning element is shaped in a form of corrugations to improve both a filter spurious performance and a filter tuning range.

* * * * *